US009366173B2

(12) United States Patent
Mah et al.

(10) Patent No.: US 9,366,173 B2
(45) Date of Patent: Jun. 14, 2016

(54) AIR INDUCTION SYSTEM HAVING AN ACOUSTIC RESONATOR

(71) Applicant: MANN+HUMMEL GMBH, Ludwigsburg (DE)

(72) Inventors: Keat Mah, Portage, MI (US); Manish Patel, Troy, MI (US)

(73) Assignee: MANN+HUMMEL GMBH, Ludwigsburg (DE)

( * ) Notice: Subject to any disclaimer, the term of this patent is extended or adjusted under 35 U.S.C. 154(b) by 0 days.

(21) Appl. No.: 14/530,777

(22) Filed: Nov. 2, 2014

(65) Prior Publication Data

US 2016/0123208 A1 May 5, 2016

(51) Int. Cl.

| | |
|---|---|
| ***F02M 35/12*** | (2006.01) |
| ***F01N 13/00*** | (2010.01) |
| ***F01N 1/04*** | (2006.01) |

(52) U.S. Cl.

CPC ..... *F01N 13/007* (2013.01); *F01N 1/04* (2013.01)

(58) Field of Classification Search

CPC ..... F02M 35/12
USPC ..... 181/229, 214; 123/184.53, 184.57
See application file for complete search history.

(56) References Cited

U.S. PATENT DOCUMENTS

| | | | | |
|---|---|---|---|---|
| 4,858,569 | A * | 8/1989 | Cser et al. | 123/184.57 |
| 7,967,106 | B2 * | 6/2011 | Ross et al. | 181/229 |
| 8,381,871 | B1 * | 2/2013 | Hellie et al. | 181/250 |
| 2012/0181107 | A1 * | 7/2012 | Hwang | 181/229 |

FOREIGN PATENT DOCUMENTS

| | | | | |
|---|---|---|---|---|
| JP | 05240120 | A * | 9/1993 | F02M 35/12 |

* cited by examiner

*Primary Examiner* — Forrest M Phillips
(74) *Attorney, Agent, or Firm* — James Hasselbeck

(57) ABSTRACT

A resonator for attenuating sound waves produced by an engine is provided. The resonator includes a housing. The housing includes first, second and third portions defining first, second and third working chambers, respectively. The first, second and third portions cooperate to define a substantially T-shaped resonator operable to attenuate sound produced by the engine.

16 Claims, 2 Drawing Sheets

AIR INDUCTION SYSTEM HAVING AN ACOUSTIC RESONATOR

FIELD

The present disclosure generally relates to an air induction system. More particularly, the present disclosure relates to an acoustic resonator of an air induction system that attenuates sound waves produced by an engine. In one particular application, the present disclosure relates to an acoustic resonator with a T-shaped tube.

BACKGROUND

This section provides background information related to the present disclosure which is not necessarily prior art.

Air induction systems are used in motor vehicles and for other applications to transport air from the environment to an engine for combustion. As air moves through the air induction system and into the engine, noise and vibration from the engine may be transmitted and amplified by the passages forming the air induction system. It order to reduce the volume and other characteristics of these noises, it may be desirable to utilize a resonator that vibrates at a frequency equal and opposite to that produced by the engine. In this manner, sound waves may be produced that cancel or reduce the sound waves produced by the engine.

In some situations, it may be desirable to provide a resonator that effectively responds to more than one sound wave, including the frequency thereof, produced by the engine. For example, when the engine is running at low RPM, it may be desirable to have a low frequency resonator to effectively suppress the sound waves produced by the engine. When the engine is running at high RPM, it may be desirable to have a high frequency resonator to effectively suppress the sound waves produced by the engine.

Different types of resonators have been used for automotive and related applications. According to one known type of acoustic resonator, a tube in communication with an engine may extend into an air filter box housing. Sound produced by the engine may be attenuated by adjusting a length that the tube extends into the air filter box housing. The sound produced by the engine may also be attenuated by adjusting a neck area of the tube.

While known resonators have generally proven to be acceptable for their intended purposes, a continued need in the relevant art remains. In this regard, packaging considerations may restrict the application of conventional manners of sound attenuation.

SUMMARY

This section provides a general summary of the disclosure, and is not a comprehensive disclosure of its full scope or all of its features.

According to one particular aspect, the present disclosure provides a resonator for attenuating sound waves produced by an engine. The resonator may include a housing. The housing may include first, second and third portions defining first, second and third working chambers, respectively. The first, second and third portions may cooperate to define a substantially T-shaped resonator operable to attenuate sound produced by the engine.

According to another particular aspect, the present disclosure provides an air induction system for attenuating sound produced by an engine. The air induction system may include a conduit and a resonator. The conduit may transmit a source of intake air to an engine. The resonator may include first, second, and third portions. The first portion may include a first end in fluid communication with the conduit. The second and third portions may be in fluid communication with a second end of the first portion and oriented generally perpendicular to the first portion.

According to yet another particular aspect, the present disclosure provides a method of attenuating sound waves produced by an engine. The method may include providing a resonator in fluid communication with a conduit for delivering a source of intake air to the engine. The resonator may have a T-shape. The method may further include attenuating sound waves produced by the engine having a first frequency with a first effective length defined by the resonator. The method may also include attenuating sound waves produced by the engine having a second frequency with a second effective length defined by the resonator. The method may further include attenuating sound waves produced by the engine having a third frequency with a third effective length defined by the resonator.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
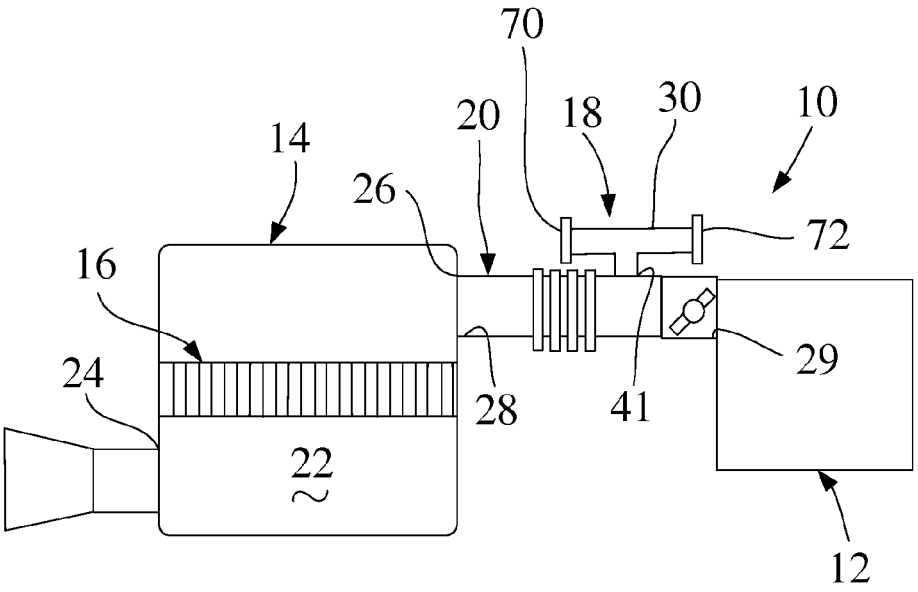
FIG. 1 is a simplified schematic view of an air induction system including a resonator in accordance with the teachings of the present disclosure, the air induction system shown operatively associated with a source of intake air and a vehicle engine.

With initial reference to FIG. 1, a simplified view of an air induction system constructed in accordance with the present teachings is illustrated and identified at reference character 10. The air induction system 10 may be used to transport and filter air from and between the environment and an engine 12 or other device utilizing a flow of air. As will be described in more detail below, the air induction system 10 may also be used to attenuate sound produced by the engine 12. By way of example only, the air induction system 10 may be used to cancel out or otherwise tune sound waves produced by the engine 12 or other noise-producing apparatus.

As shown in FIG. 1, the air induction system 10 may generally include an air filter housing 14, an air filter 16 in the air filter housing 14, a resonator 18, and a duct 20. Air from the environment may generally travel through the air induction system 10 to the engine 12 by passing through the air filter and the duct 20. As the air passes through the air filter housing 14, the air is filtered by the air filter 16. As the air passes through the duct 20 from the air filter housing 14 to the engine 12, the air passes the resonator 18.

In the embodiment illustrated, it will be understood, however, that the present teachings are not limited to this exemplary use. Rather, the present teachings may be readily adapted for use with other combustion engines, including stationary engines. The engine 12 may be an internal combustion engine for a motor vehicle (not shown).

The air filter housing 14 may define a working chamber 22 and may include an inlet 24 in fluid communication with the environment and an outlet 26 in fluid communication with the duct 20. The filter 16 may be disposed between the inlet 24 and the outlet 26. The filter 16 may conventionally filter or clean the air as it travels through the housing 14 from the environment to the duct 20. The duct 20 includes a first end 28 and a second end 29. The first end 28 may pass through the outlet 26 of the housing 14 and may extend into the working chamber 22. The second end 29 of the duct 20 may be secured in fluid communication with the engine 12 in any manner well known in the art.

Figure 2:
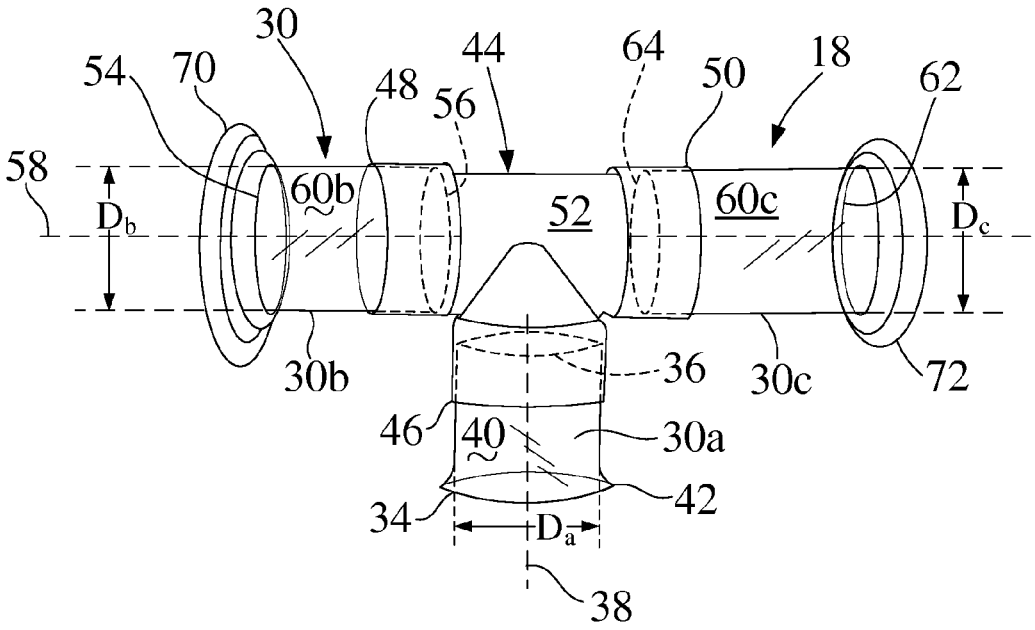
FIG. 2 is a perspective view of the resonator of FIG. 1.
Figure 3:
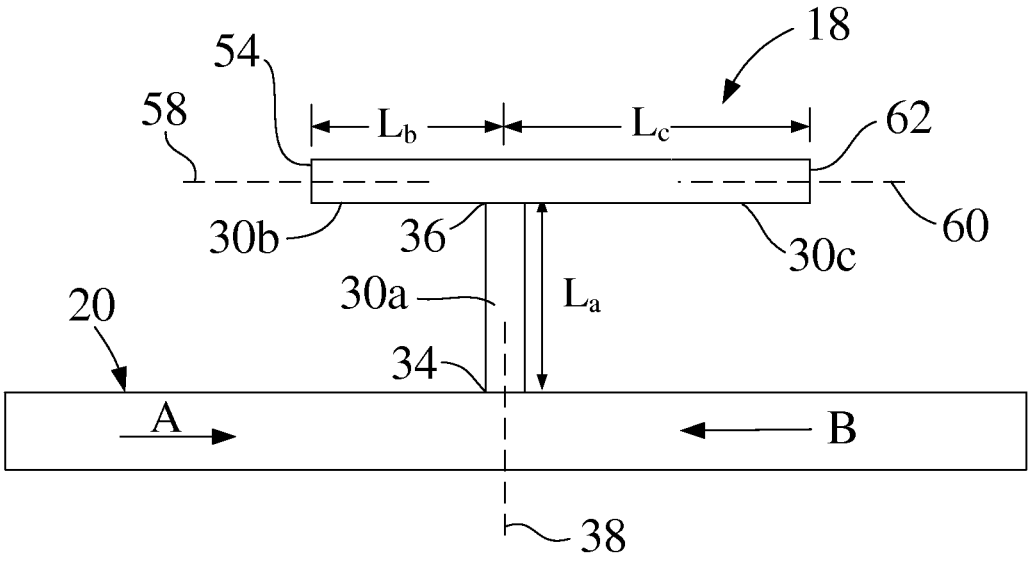
FIG. 3 is a simplified schematic view of the resonator of FIG. 1, the resonator shown operatively associated with a duct.

With continued reference to FIG. 1 and additional reference to FIGS. 2 and 3, the resonator 18 of the present disclosure will be further described. As illustrated, the resonator 18 may include a resonator housing 30. The resonator housing 30 may include a first branch or portion 30*a*, a second branch or portion 30*b* and a third branch or portion 30*c*. While the first, second and third portions 30*a*, 30*b*, 30*c* are generally shown as being discrete and/or separable components, it will be appreciated that the resonator 18, including the first, second and third portions 30*a*, 30*b*, 30*c* may be a monolithic construct within the scope of the present disclosure.

The first portion 30*a* may define a neck and may extend between a first end 34 and a second end 36 along a first axis 38. In one configuration, the first portion 30*a* may be generally cylindrical defining a working chamber 40 for attenuating sound produced by the engine 12 is attenuated. The working chamber 40 may have a diameter $D_a$. It will be appreciated, however, that the first portion 30*a* may have alternative geometries within the scope of the present disclosure. The first and second ends 34, 36 of the first portion 30*a* may be open ends. As illustrated, in an assembled configuration, the first end 34 may be mounted to and in fluid communication with the duct 20. In this regard, the duct 20 may define an opening 41 through which the first end 34 extends. The first end 34 of the first portion 30*a* may include a flared or radially extending lip portion 42 that fits within the opening 41 of the duct, and helps to provide a more secure mount between the first end 34 and the duct 20. The first end 34 may be mounted or otherwise secured to the duct 20 by welding, adhesives, mechanical fasteners, press fitting, or any other suitable fastening technique known in the art.

The second end 36 of the first portion 30*a* may be mounted to and in fluid communication with the second and third portions 30*b*, 30*c*. The second end 36 may be mounted to the second and third portions 30*b*, 30*c* by welding, adhesives, mechanical fasteners, press fit, or any other suitable fastening technique known in the art. As illustrated in FIG. 2, in one configuration the second end 36 may be mounted to the second and third portions 30*b*, 30*c* by a coupling member 44. In one configuration, the coupling member 44 is substantially T-shaped, defining first, second and third open ends 46, 48, 50 in fluid communication with a substantially T-shaped working chamber 52. In this regard, the second end 36 of the first portion 30*a* may be adjustably coupled to the first end 46 of the coupling member 44. For example, the second end 36 of the first portion 30*a* may slide within, or otherwise telescope relative to, the first end 46 of the coupling member 44, such that a distance $L_a$ between the second and/or third portions 30*b*, 30*c* and the first end 34 of the first portion 30*a* may be increased, decreased, or otherwise adjusted based on particular applications.

The second portion 30*b* may be in fluid communication with the third portion 30*c* and with the first portion 30*a*. The third portion 30*c* may, likewise, be in fluid communication with the second portion 30*b* and with the first portion 30*a*. In one configuration, the second and third portions 30*b*, 30*c* may be similarly sized and shaped. In this regard, the second portion 30*b* may extend between a first end 54 and a second end 56 along a second axis 58. The first and second ends 54, 56 of the second portion 30*b* may be open ends. In one configuration, the second portion 30*b* may be a cylinder defining a working chamber 60*b* in which sound produced by the engine 12 is attenuated. In this regard, the working chamber 60*b* may define a diameter $D_b$. It will be appreciated, however, that the second portion 30*b* may have alternative geometries within the scope of the present disclosure.

The third portion 30*c* may extend between a first end 62 and a second end 64 along a third axis 66. The first and second ends 62, 64 of the third portion 30*c* may be open ends. In one configuration, the third portion 30*c* may be a cylinder defining a working chamber 60*c* in which sound produced by the engine 12 is attenuated. In this regard, the working chamber 60*c* may define a diameter $D_c$. It will be appreciated, however, that the third portion 30*c* may have alternative geometries within the scope of the present disclosure.

With particular reference to FIG. 2, the first end 54 of the second portion 30*b* may be at least partially closed by a first cap or cover 70, and the first end 62 of the third portion 30*c* may be closed by a second cap or cover 72. The first cover 70 may be substantially similar to the second cover 72. Accordingly, like reference numerals will be used to describe like features. While the first ends 54, 62 of the second and third portions 30*b*, 30*c* are shown and described herein as being closed by covers 70, 72, respectively, it will be appreciated that the second and third portions 30*b*, 30*c* may be integrally constructed such that the first ends 54, 62, respectively, are closed ends.

In one configuration, the second end 56 of the second portion 30*b* may be adjustably coupled to the second end 48 of the coupling member 44. For example, the second end 56 of the second portion 30*b* may slide within, or otherwise telescope relative to, the second end 48 of the coupling member 44, such that a distance $L_b$ between the first axis 38 and the first end 54 of the second portion 30*b* can be increased, decreased, or otherwise adjusted based on particular applications. Similarly, the second end 64 of the third portion 30*c* may be adjustably coupled to the third end 50 of the coupling member 44. For example, in one configuration, the second end 64 of the third portion 30*c* may slide within, or otherwise telescope relative to, the third end 50 of the coupling member 44, such that a distance $L_c$ between the first axis 38 and the first end 62 of the third portion 30*c* can be increased, decreased, or otherwise adjusted based on particular applications. In another configuration, the second end 56 of the second portion 30*b* may be removably coupled to the second end 48 of the coupling member 44, and the second end 64 of the third portion 30*c* may be removably coupled to the third end 50 of the coupling. In this regard, adjustability of the second and third portions 30*b*, 30*c* can be accomplished by removing second and third portions 30*b*, 30*c* having first lengths, and replacing the second and third portions 30*b*, 30*c* having first lengths with second and third portions 30*b*, 30*c* having second lengths that are different than the first lengths.

As illustrated in FIGS. 2 and 3, in an assembled configuration, the first axis 38 may be substantially perpendicular to the second and third axes 58, 60, such that the resonator 18 is substantially T-shaped. In this regard, it will be appreciated that the working chambers 40, 60*b* and 60*c* will also substantially define a T-shape. The T-shape of the resonator 18 and the working chambers 40, 60*b* and 60*c*, may provide for the attenuation of three different frequencies of sound waves produced by the engine 12, while requiring only one opening 41 in the duct 20. In this way, the T-shaped configuration of the resonator 18 may help to reduce the packaging size for the resonator 18. In addition, the adjustability of the distances $L_a$, $L_b$, and $L_c$, as described above, means that the value of the three different frequencies can be controlled or adjusted, while capturing the half-wave effect proximate the second end 36 of the first portion 30*a*.

Operation of the air induction system 10 will now be described in more detail. An engine 12 will produce sound waves at various frequencies. For example, dominant frequencies may correspond to peak revolutions-per-minute prior to gear shifting. During operation of the engine 12, air travels along the duct 20 in a first direction A. Sound waves from the engine 12 noise travel along the duct 20 in an opposite direction B. The conduit 20 is oriented generally perpendicular to the neck or first portion 30*a* of the resonator 18. Such a resonator is conventionally referred to in the pertinent art as a Helmholtz resonator 18.

The resonator 18 of the present teachings is particularly adapted to attenuate three distinct frequencies based on different length combinations of the first, second, and third portions 30*a*, 30*b*, 30*c*. Explaining further, the resonator 18 of the present teachings is particularly adapted to attenuate first, second, and third frequency peaks $FP_1$, $FP_2$, $FP_3$. The lengths $L_a$, $L_b$, and $L_c$ of the first, second and third portions 30*a*, 30*b* and 30*c*, respectively, can be selected and/or adjusted to provide a Helmholtz, or half (½) wave resonator, and a quarter (¼) wave resonator.

The frequency peaks of the quarter (¼) wave resonators are given by the equation:

$$FP_{x,quarter\ wave} = \frac{v}{4L_{eff}}$$

The frequency peak of the half (½) wave resonator is given by the equation:

$$FP_{x,\ half\ wave} = \frac{v}{2\pi} \times \sqrt{\frac{A_a}{L_a \times (V_b + V_c)}}$$

where, v is the speed of sound in air, $A_a$ is the cross-sectional area of the first portion 30*a*, $V_b$ is the static volume of the second portion 30*b*, $V_c$ is the static volume of the third portion 30*c*, and where the resonator 18 defines first, second, and third effective lengths $L_{eff1}$, $L_{eff2}$, $L_{eff3}$:

$$L_{eff1} = \left[\frac{L_c}{L_b} \times L_c\right] + L_b + L_a$$

$$L_{eff2} = L_b + L_c$$

$$L_{eff3} = L_c + L_a$$

The first, second and third lengths $L_a$, $L_b$, and $L_c$ and the first, second and third diameters $D_a$, $D_b$, and $D_c$ can be selected such that the frequency peaks $FP_1$, $FP_2$, and $FP_3$ of the sound waves produced by the resonator 18 correspond to, and thus attenuate, the dominant frequencies of the sound waves produced by the engine 12. To change the first, second and/or third frequency peak $FP_1$, $FP_2$, and/or $FP_3$, the user can adjust the lengths $L_a$, $L_b$, and $L_c$ by adjusting the relative position of the first, second and/or third portion 30*a*, 30*b*, 30*c* relative to the first, second or third end 46, 48, 50, respectively, of the coupling member 44, in the manner described above.

According to a first non-limiting example, the first portion 30*a* has a length $L_a$ of approximately 200 mm, the second portion 30*b* has a length $L_b$ of approximately 200 mm, and the third portion 30*c* has a length $L_c$ of approximately 150 mm. In this example, the resonator 18 is particularly adapted to attenuate a first frequency $F_1$ of approximately 171 $H_z$, a second frequency $F_2$ of approximately 504 $H_z$, and a third frequency $F_3$ of approximately 702 H.

According to a second non-limiting example, the first portion 30*a* has a length $L_a$ of approximately 200 mm, the second portion 30*b* has a length $L_b$ of approximately 200 mm, and the third portion 30*c* has a length $L_c$ of approximately 100 mm. In this example, the resonator 18 is particularly adapted to attenuate a first frequency $F_1$ of approximately 182 $H_z$, a second frequency $F_2$ of approximately 558 $H_z$, and a third frequency $F_3$ of approximately 806 H.

The foregoing description is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A resonator for attenuating sound waves produced by an engine, the resonator comprising:

a resonator housing including first, second and third portions defining first, second and third working chambers, respectively;

wherein the first, second and third portions cooperate to define a substantially T-shaped resonator operable to attenuate sound produced by the engine;

the resonator is adapted to attenuate sound waves produced by the engine having at least two different frequencies;

a coupling member having a first opening, a second opening and a third opening, wherein the first, second and third portions extend from the first, second and third openings, respectively;

wherein the first portion has a first end connected to an air induction system of the engine, and a second end connected to and in fluid communication with the coupling member;

wherein the second and third portions each have a first end connected to and in fluid communication with the coupling member and are oriented generally perpendicular to the first portion;

wherein the second end of the first portion is arranged to slide within or otherwise telescope relative to the coupling member such that the length of the first portion is adjustable for tuning the resonator.

2. The resonator of claim 1, wherein the second portion and/or third portion is arranged to slide within or otherwise telescope relative to the coupling member such that the length of the second portion and/or third portion is adjustable for tuning the resonator.

3. The resonator of claim 1, wherein the resonator is adapted to attenuate sound waves produced by the engine having three dominant frequencies.

4. The resonator of claim 1, wherein the resonator has a first effective length Leff1 for attenuating sound waves defined by Leff1=(Lc/Lb)*Lc+Lb+La, where Lc is a length of the third portion, Lb is a length of the second portion, and La is a length of the first portion.

5. The resonator of claim 4, wherein the resonator has a second effective length Leff2 for attenuating sound waves defined by Leff2=Lc+Lb.

6. The resonator of claim 5, wherein the resonator has a third effective length Leff3 for attenuating sound waves defined by Leff3=Lc+La.

7. The resonator of claim 1, wherein the resonator defines first, second, and third effective lengths for respectively alternating first, second, and third distinct frequencies.

8. An air induction system for attenuating sound waves produced by an engine, the air induction system comprising:

a conduit for transmitting a source of intake air to an engine; and a resonator including first, second, and third portions, the first portion having a first end connected to and in fluid communication with the conduit, the second and third portions in fluid communication with a second end of the first portion and oriented generally perpendicular to the first portion;

wherein the resonator is adapted to attenuate sound waves produced by the engine having at least two different frequencies;

a coupling member having a first opening, a second opening and a third opening, wherein the first, second and third portions extend from the first, second and third openings, respectively;

wherein the second end of the first portion is connected to and in fluid communication with the coupling member;

wherein the second and third portions each have a first end connected to and in fluid communication with the coupling member and are oriented generally perpendicular to the first portion;

wherein the second end of the first portion is arranged to slide within or otherwise telescope relative to the coupling member such that the length of the first portion is adjustable for tuning the resonator.

9. The air induction system of claim 8, wherein the second portion and/or third portion is arranged to slide within or otherwise telescope relative to the coupling member such that the length of the second portion and/or third portion is adjustable for tuning the resonator.

10. The air induction system of claim 8, wherein the resonator is adapted to attenuate sound waves produced by the engine having three distinct frequencies.

11. The resonator of claim 8, wherein the resonator has a first effective length Leff1 for attenuating sound waves defined by Leff1=(Lc/Lb)*Lc+Lb+La, where Lc is a length of the third portion, Lb is a length of the second portion, and La is a length of the first portion.

12. The resonator of claim 11, wherein the resonator has a second effective length Leff2 for attenuating sound waves defined by Leff2=Lc+Lb.

13. The resonator of claim 12, wherein the resonator has a third effective length Leff3 for attenuating sound waves defined by Leff3=Lc+La.

14. The air induction system of claim 8, wherein the resonator defines first, second, and third effective lengths for respectively alternating first, second, and third distinct frequencies.

15. A method of attenuating sound waves produced by an engine, the method comprising:

providing a resonator in fluid communication with a conduit for delivering a source of intake air to the engine, the resonator having a T-shape, including a first portion, a second portion and a third portion;

tuning the resonator by sliding or otherwise telescoping the first and/or second and/or third portions to change the length of the respective first, second or third portions;

attenuating sound waves produced by the engine having a first frequency with a first effective length defined by the resonator;

attenuating sound waves produced by the engine having a second frequency with a second effective length defined by the resonator; and attenuating sound waves produced by the engine having a third frequency with a third effective length defined by the resonator.

16. The method of claim 15, wherein:

the first effective length Leff1 is defined by Leff1=(Lc/Lb)*Lc+Lb+La, where Lc is a length of the third portion, Lb is a length of the second portion, and La is a length of the first portion;

the second effective length Leff2 is defined by Leff2=Lc+Lb; and the third effective length is defined by Leff3=Lc+La.

* * * * *